US006045129A

United States Patent [19]

Cooper et al.

[11] Patent Number: 6,045,129

[45] Date of Patent: Apr. 4, 2000

[54] METHOD OF PLAYING A VIDEO POKER GAME

[76] Inventors: Dual Cooper, 2100 N. Boulder Hwy., Henderson, Nev. 89015; Michael W. Wood; W. George Cochran, both of 11831 Wentling Ave., Suite #C, Baton Rouge, La. 70816

[21] Appl. No.: 09/104,301

[22] Filed: Jun. 24, 1998

Related U.S. Application Data

[60] Provisional application No. 60/081,121, Apr. 8, 1998.

[51] Int. Cl.[7] ..... A63F 1/00

[52] U.S. Cl. ..... 273/292; 463/13

[58] Field of Search ..... 463/13; 273/292, 273/274, 309

[56] References Cited

U.S. PATENT DOCUMENTS

| | | | |
|---|---|---|---|
| 5,411,257 | 5/1995 | Fulton | 463/13 |
| 5,531,441 | 7/1996 | Dabrowski et al. | 463/12 |
| 5,882,259 | 3/1999 | Holmes, Jr. et al. | 463/13 |

*Primary Examiner*—Benjamin H. Layno

*Attorney, Agent, or Firm*—John Edward Roethel

[57] ABSTRACT

Using an electronic video poker gaming machine, an initial five card hand is dealt and displayed to a player. The player selects which cards to hold and the unheld cards are discarded. Replacement cards are dealt to the player and the poker hand ranking of the final five card hand is determined. If the player has achieved a losing hand, the player is offered the opportunity to replay the initial five card hand. The player may hold the same or different cards when he replays the initial five card hand. The remaining cards are reshuffled and new replacement cards are dealt to the player. Winning hands are paid. The player must make a separate wager each time the player wishes to replay the initial five card hand. In one version, the player is only offered the opportunity to replay the initial five card hand if the player has a losing hand on the first play of the hand. In another version, the player is offered the chance to replay the initial five card hand regardless of whether the player wins or loses on the first play of the hand. The number of replays offered to the player for any particular initial five card hand can vary. In yet another version, the player is randomly offered an opportunity to replay a hand.

30 Claims, 3 Drawing Sheets

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR–OF–A–KIND (ACES) | 100 | 200 | 300 | 400 | 500 |
| FOUR–OF–A–KIND (2'S,3'S AND 4'S) | 50 | 100 | 150 | 200 | 250 |
| FOUR–OF–A–KIND (5'S THRU KINGS) | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE–OF–A–KIND | 2 | 4 | 6 | 8 | 10 |
| TWO PAIR | 1 | 2 | 3 | 4 | 5 |
| JACKS OR BETTER | 1 | 2 | 3 | 4 | 5 |

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 100 | 200 | 300 | 400 | 500 |
| FOUR-OF-A-KIND (2'S,3'S AND 4'S) | 50 | 100 | 150 | 200 | 250 |
| FOUR-OF-A-KIND (5'S THRU KINGS) | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 100 | 200 | 300 | 400 | 500 |
| FOUR-OF-A-KIND (2'S,3'S AND 4'S) | 50 | 100 | 150 | 200 | 250 |
| FOUR-OF-A-KIND (5'S THRU KINGS) | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

METHOD OF PLAYING A VIDEO POKER GAME

CROSS-REFERENCE TO RELATED APPLICATION

This application is based on and is a Continuation-in-Part of Provisional Application Ser. No. 60/081,121, filed Apr. 8, 1998, entitled "Video Poker Game."

This invention relates to a video poker game, and more particularly to a video poker game in which the player is given the opportunity to replay the initial five card deal.

BACKGROUND OF THE INVENTION

Electronic video poker games have been prevalent in gaming casinos for many years. The basic game of video poker involves a game of five card draw. Using a single deck of cards, the player is dealt an initial five card hand. The player selects which of the initial five cards the player wishes to hold and the unheld cards are then discarded. Using the same starting deck of cards, replacement cards are dealt for the cards that were discarded. These five cards comprise the player's final five card hand and this final hand is analyzed based on poker hand ranking. If the player has achieved at least a pair of Jacks or better, the player wins with the amount of the player's winnings determined based on the type of poker hand achieved and the amount of the player's wager.

Video poker is generally played on an electronic video gaming machine that uses a video screen display to show the cards to the player. Computer controls carried on a printed circuit board mounted on the interior of the gaming machine electronically shuffle the deck of cards, activate the dealing sequence in response to input by a player, cause the initial five cards to be displayed on the video screen display, deal replacement cards after the player has selected which cards to hold and discard and analyze the final five card hand to determine winning and losing hands. The computer controls also effect payouts to the player based on the amount of the player's wager and the poker hand ranking of the final five card hand.

The electronic video poker gaming machine is designed to replicate the play of a hand of poker. Typically, the player is not playing against any other players or against a dealer's hand; the player is simply attempting to achieve the highest ranking poker hand possible from the cards displayed to the player. The higher the poker hand achieved by the player, the greater the player's winnings based on the number of coins, tokens or credits wagered by the player. Typically, a payout schedule is posted on the gaming machine to advise the player of the payoffs available for certain winning card combinations.

The original classic draw poker machines were then modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved.

Players have become bored with traditional video draw poker and gaming casino operators are desirous of having different types of electronic video poker games to offer to the players. There is a need to provide new and interesting electronic video poker games that attract players and that can increase the volume of wagering in each gaming machine.

Also, as players become more sophisticated regarding electronic video poker gaming machines, players prefer to play those poker machines that have pay tables with higher payouts for the types of poker hand rankings that are achievable. There is a need for new video poker gaming machines that are capable of encouraging a high volume of play while at the same time offering what the players consider to be good pay tables.

It is an object of the present invention to provide a new and interesting form of video poker which will attract players and increase the number of hands that can be played in a given time period while at the same time offering the player a good pay table.

It is a feature of the present invention to offer the player an opportunity to return to his initial five card hand after he has completed the draw step, and replay these first five cards and obtain a new draw of replacement cards.

It is an advantage of the present invention that a player will be attracted to a video poker game in which the player can replay his starting hand. A player has a better chance to obtain high ranking poker hands when the player is provided with a good starting hand. Thus, offering the player a chance to replay a good starting hand will encourage additional play of the game. More hands in a given time period can be played since replaying the initial five card deal takes less time than dealing a completely new five card hand.

Other objects, features and advantages of the present invention will become apparent from a consideration of the following detailed description.

SUMMARY OF THE INVENTION

Using an electronic video poker gaming machine, an initial five card hand is dealt and displayed to a player. The player selects which cards to hold and the unheld cards are discarded. Replacement cards are dealt to the player and the poker hand ranking of the final five card hand is determined. If the player has achieved a losing hand, the player is offered the opportunity to replay the initial five card hand. The player may hold the same or different cards when he replays the initial five card hand. The remaining cards are reshuffled and new replacement cards are dealt to the player. Winning hands are paid. In the preferred embodiment of the present invention, the player must make a separate wager each time the player wishes to replay the initial five card hand.

In one version of the present invention, the player is only offered the opportunity to replay the initial five card hand if the player has a losing hand on the first play of the hand. In another version of the present invention, the player is offered the chance to replay the initial five card hand regardless of whether the player wins or loses on the first play of the hand.

The number of replays offered to the player for any particular initial five card hand is not critical, although the preferred embodiment of the present invention would offer the player a single replay.

The method of the present invention can be applied to regular Draw Poker as well as any of the variations of Draw Poker, including but not limited to, Deuces Wild Draw Poker, Joker's Wild Draw Poker and One-Eyed Jacks Wild Draw Poker. In yet another variation of the present invention, the player can be randomly offered an opportunity to replay the initial starting hand.

DETAILED DESCRIPTION OF THE PREFERRED EMBODIMENTS

Figure 1:
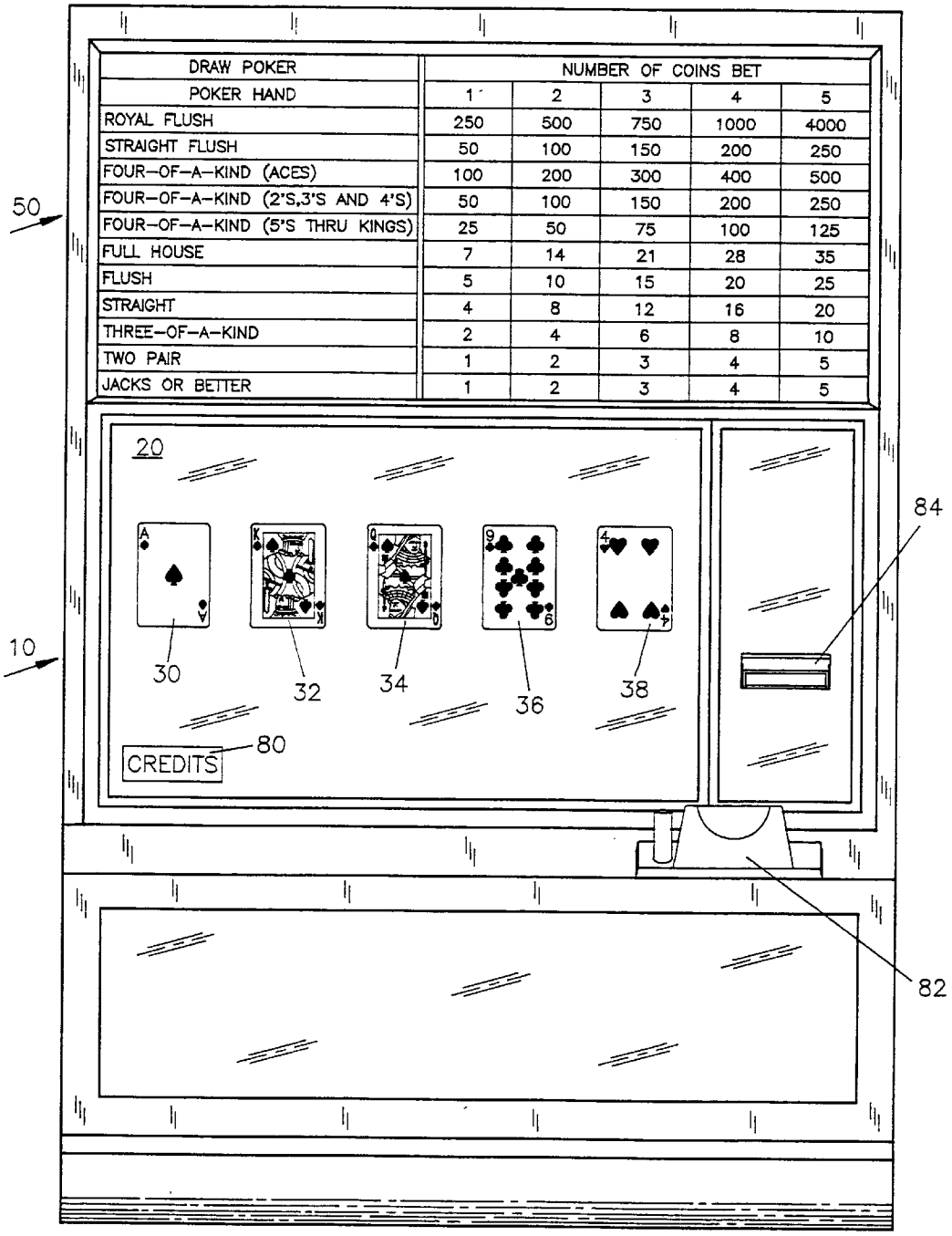
FIG. 1 shows a front view of an electronic video poker gaming machine displaying a suitable pay table and a video display of the method of the present invention after the initial deal of five cards.

An electronic video poker gaming machine upon which the method of the present invention can be practiced is shown at 10 in FIG. 1. The gaming machine 10 includes a video display screen 20, a payout table 50, a coin head 82 into which players may introduce coins or tokens and a bill acceptor 84 into which players may introduce paper currency, all of which are conventional in electronic video poker gaming machines.

The screen display 20 is sized to display five playing cards as well as a credit meter display 80. As is also conventional (but not shown), buttons are provided on the button panel by which the player operates the gaming machine to cause cards to be dealt, held and discarded. A cashout button is also provided to cause any credits accrued to be cashed out by the player. Instead of using buttons on the button panel to operate the gaming machine 10, conventional touch screen technology can also be used. Any suitable electronic video poker gaming machine can be modified so that the method of the present invention can be practiced thereon.

The player introduces coins or gaming tokens into the coin head 82 or paper currency into the bill acceptor 84 to activate the gaming machine 10. The player wagers the desired number of coins, tokens or credits and then activates the gaming machine by pressing a "Deal" button (not shown) on the button panel to cause the initial deal of the cards to be displayed on the video screen 20. Any coins or tokens or value from paper currency introduced in excess of the amount the player wishes to wager are accrued as credits on the credit meter 80.

In the preferred embodiment of the present invention, five cards dealt from a first deck of fifty-two cards are displayed face up on the video screen 20. In the example shown in FIG. 1, the player is dealt the Ace ♠ 30, King ♠ 32, Queen ♠ 34, Nine ♣ 36 and Four ♥ 38. As is conventional in video draw poker, the player then selects which of these initial five cards the player wishes to hold by pressing the "Hold" buttons (not shown) on the button panel or, if touch screen technology is being employed, by pressing the video screen 20 at the location of the cards the player wishes to hold.

In this example, the player would most likely hold the Ace ♠ 30, King ♠ 32 and Queen ♠ 34. The Nine ♣ and Four ♥ would be discarded and replacement cards from the original deck of cards would be displayed on the video screen 20.

Figure 2:
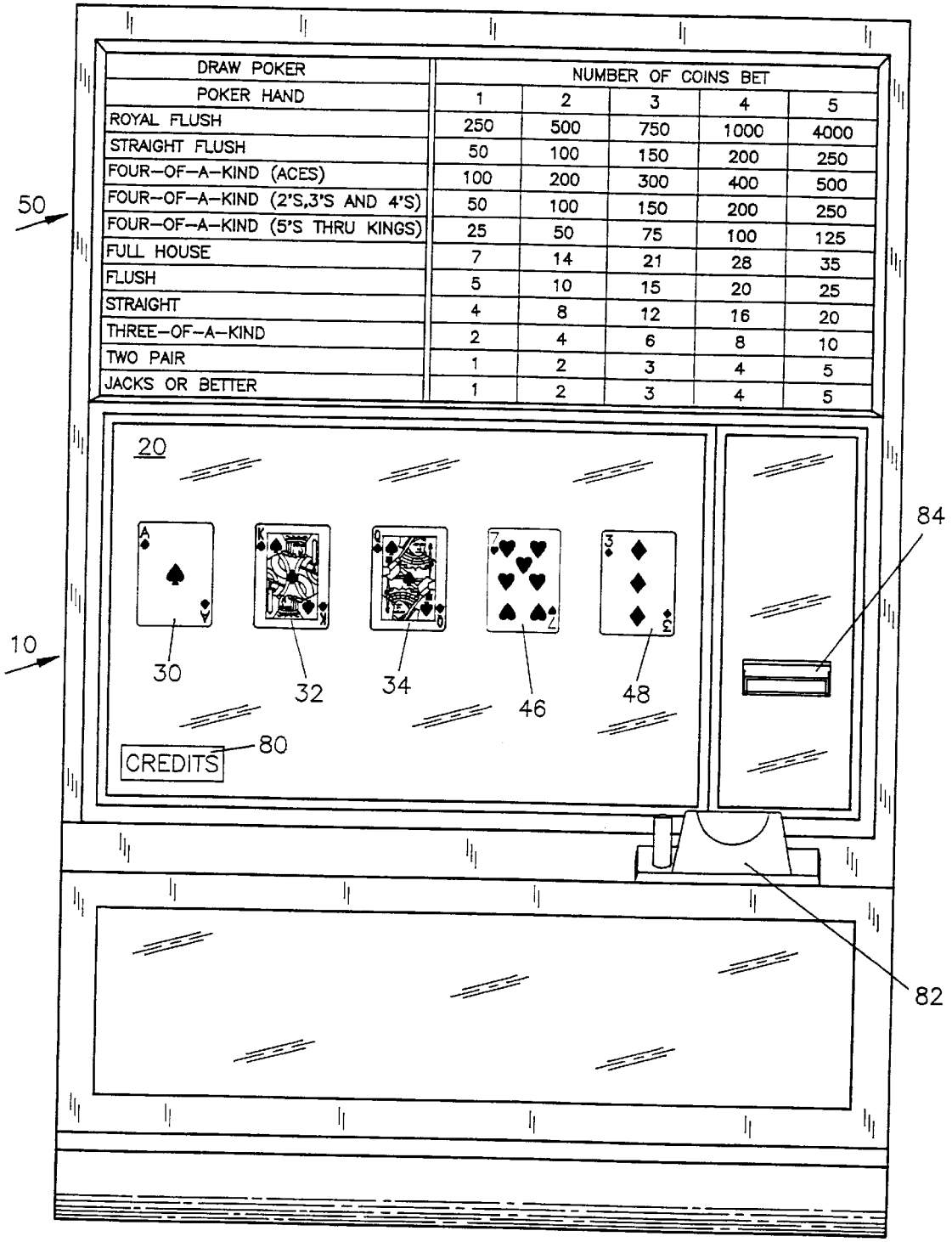
FIG. 2 shows a front view of an electronic video poker gaming machine with a video display of the method of the present invention after the draw.

FIG. 2 shows an example of the video screen display 20 after the player has selected which cards to hold from the initial deal and after the replacement cards have been displayed. The replacement cards are the Seven ♥ 46 and Three ♦ 48. Since the player has not received at least a Pair of Jacks or better, this is a losing hand and the player is offered the opportunity to replay his initial five card hand. A replay button (not shown) can be provided on the button panel or a replay location can be provided on the video screen 20 which the player can press to select this option of replaying the starting hand. If the player elects to replay his starting hand, the same wager that the player made for the first hand is required for the replay hand. The player either needs to introduce more coins, tokens or paper currency to make this additional wager or the player can use any accrued credits that the player may have on the credit meter 80.

If the player elects to replay his starting hand, the player has redisplayed to him the same five cards that were displayed on the initial deal. In the example, the player would receive the Ace ♠ 30, King ♠ 32, Queen ♠ 34, Nine ♣ 36 and Four ♥ 38 as shown in FIG. 1. The remaining cards in the deck are then randomly shuffled to provide a new order of cards for the replacement cards.

As occurred the first time the player played this hand, the player then selects which of these initial five cards the player wishes to hold by pressing the "Hold" buttons (not shown) on the button panel or, if touch screen technology is being employed, by pressing the video screen 20 at the location of the cards the player wishes to hold.

In this example, the player would again most likely hold the Ace ♠ 30, King ♠ 32 and Queen ♠ 34. The Nine ♣ 36 and Four ♥ 38 would be discarded and replacement cards from the original deck of cards would be displayed on the video screen 20.

Figure 3:
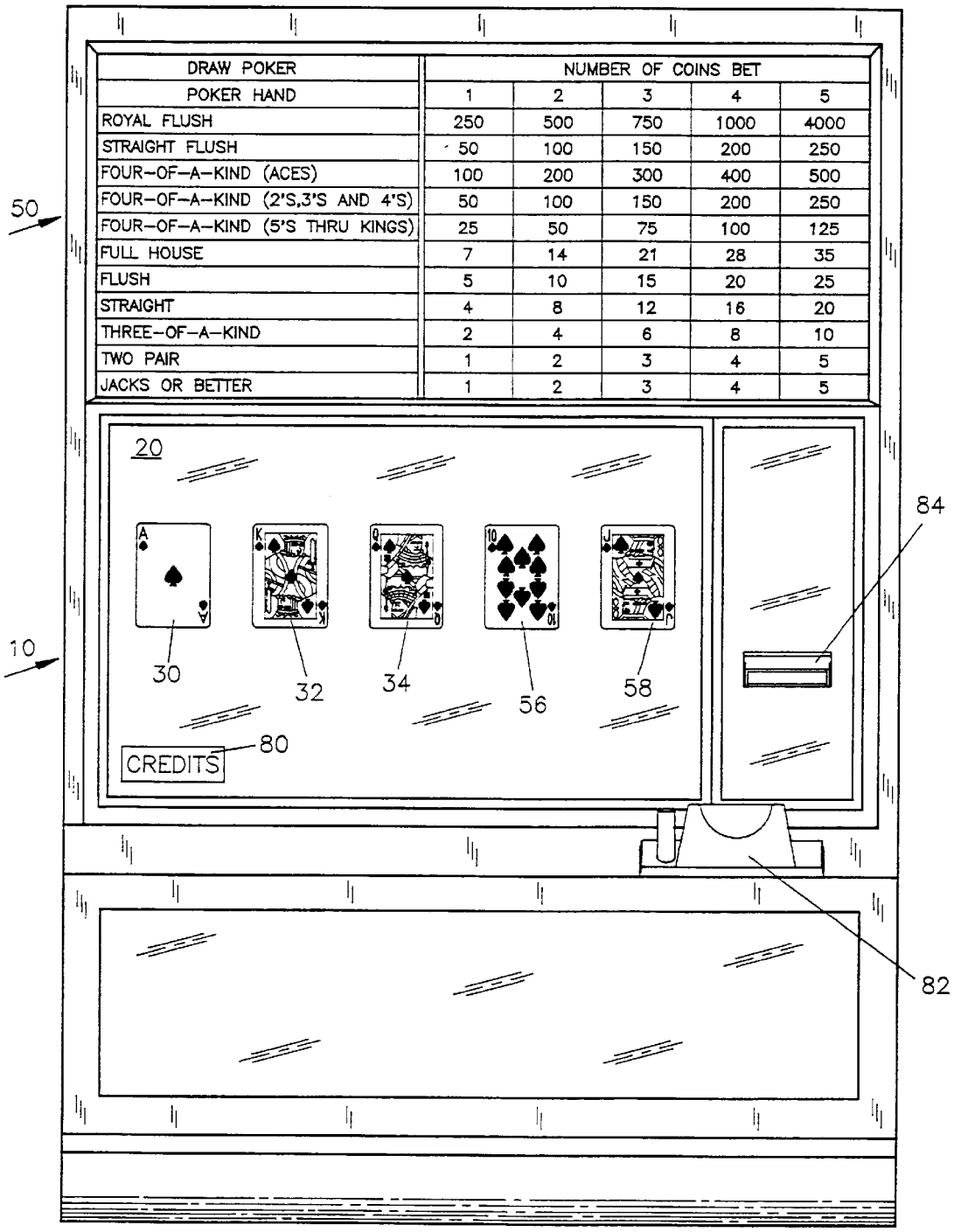
FIG. 3 shows a front view of an electronic video poker gaming machine with a video display of the method of the present invention after a replay of the initial starting hand and another draw.

FIG. 3 shows an example of the video screen display 20 after the player has selected which cards to hold from the initial deal on the replay of the starting hand and after the replacement cards have been displayed. The replacement cards are the Ten ♠ 56 and Jack ♠ 58. On the replay of the starting hand, the player has achieved a Royal Flush and is a winner.

In the preferred embodiment of the present invention the player is only allowed to replay his starting hand if the player loses on his first hand. The number of replays that are made available to the player would most preferably be only one, but the player can be offered two or more replays if desired by the gaming establishment. The pay table would be modified to reflect the probabilities that are changed by allowing the player to replay his starting hand more than once.

The amount that the player wins is displayed on a pay table 50 and is based on the poker hand ranking of the hand achieved by the player and the amount wagered by the player.

Table 1 shows a representative pay table that can be used in the method of the present invention in which the player is only allowed to replay his starting hand if the player loses on his first hand.

TABLE 1

| | NUMBER OF COINS BET | | | | |
|---|---|---|---|---|---|
| POKER HAND | 1 | 2 | 3 | 4 | 5 |
| ROYAL FLUSH | 800 | 1600 | 2400 | 3200 | 4000 |
| STRAIGHT FLUSH | 50 | 100 | 150 | 200 | 250 |
| FOUR OF A KIND | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

This pay table is based on a simple Draw Poker pay table and can be modified with any desired payouts depending on the return which the gaming establishment wishes to offer to the player. Other types of pay tables can be used such as the Double Bonus pay tables, Double Double Bonus pay tables, Triple Bonus pay tables and the like.

This version of the method of the present invention can also be applied to Deuces Wild poker, Jokers Wild poker and other video poker variations. Depending on the type of video poker to which the method of the present invention is applied, the pay table will be modified to provide a suitable hold percentage as desired by the gaming establishment.

Another embodiment of the present invention would allow the player to replay his starting hand regardless of whether the player has won or lost on the initial hand dealt to the player. For example, the player may have initially been dealt the Four ♠, Five ♠, Six ♠, Seven ♠ and Queen ♦. The player would probably hold the four cards of the same suit and try to draw a fifth card to complete the Flush. If the player draws a fifth spade, for example the Ace ♠, the player would win for a Flush and be paid to the credit meter. The player could then replay the initial five card starting hand and again try to achieve a Flush or perhaps even a Straight Flush.

As another example, the player may have initially been dealt the Four ♠, Five ♠, Six ♠, Seven ♠ and Queen♠. This hand is a Flush and the player has initially two options with this hand: 1) the player can hold the Flush and collect his winnings, or 2) the player can discard the Queen ♠ and try and draw to the Straight Flush. If the player chooses the second option, he may achieve the Straight Flush, he may achieve a simple Flush again, he may achieve a simple Straight or he may achieve a losing hand.

Regardless of which option the player chooses, the player can then replay this hand by making another wager and have the same two options. Alternatively, the player could hold all of the first five cards and be paid for a Flush. The player could then replay the starting hand, again hold the Flush or even discard the Queen ♠ and try for a Straight Flush.

The number of replays that are made available to the player would most preferably be only one, but the player can be offered two or more replays if desired by the gaming establishment. The pay table would be modified to reflect the fact that the probabilities have been changed by allowing the player to replay after a winning hand and to reflect the probabilities of allowing the player to replay his starting hand more than once.

The pay table shown in Table 2 is a representative pay table for this version of the present invention in which the player may replay any starting hand regardless of whether the player wins or loses on his first hand.

TABLE 2

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 100 | 200 | 300 | 400 | 500 |
| FOUR 2's, 3's or 4's | 50 | 100 | 150 | 200 | 250 |
| FOUR 5's THRU KINGS | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

This pay table is based on a Double Bonus pay table and can be modified with any desired payouts depending on the return which the gaming establishment wishes to offer to the player. Other types of pay table can be used such as the basic Draw Poker pay table, Double Double Bonus pay tables, Triple Bonus pay tables and the like.

This version of the method of the present invention can also be applied to Deuces Wild poker, Jokers Wild poker, One-Eyed Jacks Wild poker and other video poker variations. Depending on the type of video poker to which the method of the present invention is applied, the pay table will be modified to provide a suitable hold percentage as desired by the gaming establishment.

For example, in Deuces Wild poker, each Deuce that is dealt is considered to be a wild card. The wild card or cards received by the player are combined with the other cards displayed to create the highest ranking poker hand. Special payouts are provided for obtaining Four Deuces or a Wild Royal Flush.

The pay table shown in Table 3 is a representative pay table for this version of the present invention in which Deuces are wild and in which the player may replay a starting hand one time and only if the player loses on his first hand.

TABLE 3

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| FOUR DEUCES | 200 | 400 | 600 | 800 | 1000 |
| WILD ROYAL FLUSH | 20 | 40 | 60 | 80 | 100 |
| FIVE OF A KIND | 10 | 20 | 30 | 40 | 50 |
| STRAIGHT FLUSH | 10 | 20 | 30 | 40 | 50 |
| FOUR OF A KIND | 4 | 8 | 12 | 16 | 20 |
| FULL HOUSE | 4 | 8 | 12 | 16 | 20 |
| FLUSH | 3 | 6 | 9 | 12 | 15 |
| STRAIGHT | 2 | 4 | 6 | 8 | 10 |
| THREE-OF-A-KIND | 1 | 2 | 3 | 4 | 5 |

This Deuces Wild version of the present invention can also be practiced so that the player is offered the opportunity to replay his starting hand one or more times regardless of whether the player wins or loses on the first hand. However, the pay table would have to modified if the player can replay his starting hand regardless or whether the player wins or loses on the first hand and if the player is allowed to replay his starting hand more than once.

In a preferred embodiment of the present invention which uses Deuces Wild, the pay table shown in Table 3 can be used if the player is offered the opportunity to replay his starting hand one time regardless of whether the player wins or loses on his first hand unless the player has been dealt a Three-of-a-Kind or a Four-of-a-Kind on the initial five cards.

If the present invention is applied to draw poker games in which a Joker is added to the standard deck of 52 cards and the Joker is a wild card, then a different pay table must be used. For example, in Joker's Wild poker where the Joker that is dealt is considered to be a wild card, if the Joker is received by the player, it is combined with the other cards displayed to create the highest ranking poker hand. Special payouts are provided for obtaining Five of a Kind or a Wild Royal Flush. In typical Joker's Wild poker, the lowest winning hand is a Pair of Kings or Better.

The pay table shown in Table 4 is a representative pay table for this version of the present invention in which the Joker is wild and in which the player may replay a starting hand one time and only if the player loses on his first hand.

The lowest winning hand is a Pair of Kings or Better and the highest winning hand is a Royal Flush.

TABLE 4

| | NUMBER OF COINS BET | | | | |
|---|---|---|---|---|---|
| POKER HAND | 1 | 2 | 3 | 4 | 5 |
| ROYAL FLUSH | 500 | 1000 | 1500 | 2000 | 4700 |
| FIVE OF A KIND | 400 | 800 | 1200 | 1600 | 2000 |
| WILD ROYAL FLUSH | 50 | 100 | 150 | 200 | 250 |
| STRAIGHT FLUSH | 50 | 100 | 150 | 200 | 250 |
| FOUR OF A KIND | 14 | 28 | 42 | 56 | 70 |
| FULL HOUSE | 6 | 12 | 18 | 24 | 30 |
| FLUSH | 5 | 10 | 15 | 20 | 25 |
| STRAIGHT | 3 | 6 | 9 | 12 | 15 |
| THREE-OF-A-KIND | 2 | 4 | 6 | 8 | 10 |
| TWO PAIR | 1 | 2 | 3 | 4 | 5 |
| PAIR OF KINGS OR BETTER | 1 | 2 | 3 | 4 | 5 |

This Joker's Wild version of the present invention can also be practiced so that the player is offered the opportunity to replay his starting hand one or more times regardless of whether the player wins or loses on the first hand. However, the pay table would have to modified if the player can replay his starting hand regardless or whether the player wins or loses on the first hand and if the player is allowed to replay his starting hand more than once.

In a preferred embodiment of the present invention which uses a Joker as a Wild, the pay table shown in Table 5 can be used if the player is offered the opportunity to replay his starting hand one time regardless of whether the player wins or loses on his first hand.

TABLE 5

| | NUMBER OF COINS BET | | | | |
|---|---|---|---|---|---|
| POKER HAND | 1 | 2 | 3 | 4 | 5 |
| ROYAL FLUSH | 400 | 800 | 1200 | 1600 | 4000 |
| FIVE OF A KIND | 200 | 400 | 600 | 800 | 1000 |
| WILD ROYAL FLUSH | 100 | 200 | 300 | 400 | 500 |
| STRAIGHT FLUSH | 50 | 100 | 150 | 200 | 250 |
| FOUR OF A KIND | 11 | 22 | 33 | 44 | 55 |
| FULL HOUSE | 6 | 12 | 18 | 24 | 30 |
| FLUSH | 5 | 10 | 15 | 20 | 25 |
| STRAIGHT | 3 | 6 | 9 | 12 | 15 |
| THREE-OF-A-KIND | 1 | 2 | 3 | 4 | 5 |
| TWO PAIR | 1 | 2 | 3 | 4 | 5 |
| PAIR OF KINGS OR BETTER | 1 | 2 | 3 | 4 | 5 |

Likewise, if the One-Eyed Jacks (the Jack♥ and Jack ♠ are considered wild cards, another pay table must be used. For example, in One-Eyed Jack's Wild poker where either of the One-Eyed Jacks is considered to be a wild card, it is combined with the other cards displayed to create the highest ranking poker hand. Special payouts are provided for obtaining Five of a Kind or a Wild Royal Flush. In this version of One-Eyed Jacks Wild poker, the lowest winning hand is Two Pair. The pay table shown in Table 6 is a representative pay table for this version of the present invention in which either of the One-Eyed Jacks is wild and in which the player may replay a starting hand one time and only if the player loses on his first hand. The lowest winning hand is Two Pair and the highest winning hand is a Royal Flush.

TABLE 6

| | NUMBER OF COINS BET | | | | |
|---|---|---|---|---|---|
| POKER HAND | 1 | 2 | 3 | 4 | 5 |
| ROYAL FLUSH | 400 | 800 | 1200 | 1600 | 4000 |
| WILD ROYAL FLUSH | 200 | 400 | 600 | 800 | 1000 |
| FIVE OF A KIND | 100 | 200 | 300 | 400 | 500 |
| STRAIGHT FLUSH | 50 | 100 | 150 | 200 | 250 |
| FOUR OF A KIND | 11 | 22 | 33 | 44 | 55 |
| FULL HOUSE | 5 | 10 | 15 | 20 | 25 |
| FLUSH | 3 | 6 | 9 | 12 | 15 |
| STRAIGHT | 2 | 4 | 6 | 8 | 10 |
| THREE-OF-A-KIND | 1 | 2 | 3 | 4 | 5 |
| TWO PAIR | 1 | 2 | 3 | 4 | 5 |

This One-Eyed Jack's Wild version of the present invention can also be practiced so that the player is offered the opportunity to replay his starting hand one or more times regardless of whether the player wins or loses on the first hand. However, the pay table would have to modified if the player can replay his starting hand regardless or whether the player wins or loses on the first hand and if the player is allowed to replay his starting hand more than once.

Another variation of the present invention randomly provides the player an opportunity to replay his starting hand if the player has a losing hand on his first hand or regardless of whether the player has a winning or losing hand on his first hand. In this variation, the computer controls that operate the gaming machine are programmed to randomly offer the player a replay of his starting hand. If the player receives this offer to replay of his starting hand, the player may accept or decline this offer. If the player accepts the offer, the player makes another wager and replays his starting hand by either standing on his first five cards or discarding one or more of his first five cards and receiving replacement cards. The final five card is analyzed to determine if the player has achieved a winning hand based on poker hand rankings.

Preferably, the computer controls are programmed to offer a replay on a random basis once every ten to forty hands. The pay table shown in Table 7 is a representative pay table for this version of the present invention in which the player is offered on a random basis once every twenty hands the opportunity to replay any starting hand regardless of whether the player wins or loses on his first play of the hand.

TABLE 7

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

This version of the present invention in which the player is randomly offered a replay of his starting hand can be applied to any type of Draw Poker and a suitable pay table is provided for the type of Draw Poker to which the variation is applied. Alternatively, the player can be offered on a random basis the opportunity to replay his starting hand only if the player loses on his first hand or only if the player wins on his first hand.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description.

What is claimed is:

1. A method of playing a draw poker game comprising:

a) dealing an initial five card hand to a player;

b) the player either standing on the initial hand or discarding one or more cards from the initial hand;

c) dealing the player replacement cards for the discarded cards, if any, to form a final five card hand;

d) determining a value for the player's final five card hand based on poker hand ranking;

e) if the player's final five card hand is a winning hand, awarding the player a predetermined amount based on the value of the player's final five card hand; and f) if the player's final five card hand is a losing hand, offering the player an opportunity to replay his initial hand by discarding the player's final five card hand and re-dealing to the player the same initial five card hand having cards of the same suit and rank that were dealt to the player in step (a), and repeating steps (b) through (e).

2. The method of claim 1 in which each deck of playing cards is a standard 52 card deck.

3. The method of claim 1 in which each deck of playing cards is a standard 52 card deck plus at least one extra Joker card which is treated as a wild card.

4. The method of claim 1 in which each deck of playing cards is a standard 52 card deck with at least one of the cards being treated as a wild card.

5. The method of claim 1 in which the value of the player's final five card hand is determined by comparing the poker hand ranking of the player's final five card hand to a payout schedule.

6. The method of claim 5 in which the predetermined amount based on the value of the player's final five card hand is based on a payout schedule.

7. The method of claim 6 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 800 | 1600 | 2400 | 3200 | 4000 |
| STRAIGHT FLUSH | 50 | 100 | 150 | 200 | 250 |
| FOUR OF A KIND | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5. |

8. The method of claim 1 further including the player wagering at least one coin to be eligible to participate in the game and in which the predetermined amount that the player is paid is based on the number of coins wagered by the player.

9. The method of claim 8 further including the player making a second wager to replay his initial hand.

10. The method of claim 1 in which the game is displayed on a video display screen on an electronic gaming machine.

11. A method of playing a draw poker game comprising:

a) dealing an initial five card hand to a player;

b) the player either standing on the initial hand or discarding one or more cards from the initial hand;

c) dealing the player replacement cards for the discarded cards, if any, to form a final five card hand;

d) determining a value for the player's final five card hand based on poker hand ranking;

e) if the player's final five card hand is a winning hand, awarding the player a predetermined amount based on the value of the player's final five card hand; and f) offering the player an opportunity to replay his initial hand by discarding the player's final five card hand and re-dealing to the player the same initial five card hand having cards of the same suit and rank that were dealt to the player in step (a), and repeating steps (b) through (e).

12. The method of claim 11 in which each deck of playing cards is a standard 52 card deck.

13. The method of claim 11 in which each deck of playing cards is a standard 52 card deck plus at least one extra Joker card which is treated as a wild card.

14. The method of claim 11 in which each deck of playing cards is a standard 52 card deck with at least one of the cards being treated as a wild card.

15. The method of claim 11 in which the value of the player's final five card hand is determined by comparing the poker hand ranking of the player's final five card hand to a payout schedule.

16. The method of claim 15 in which the predetermined amount based on the value of the player's final five card hand is based on a payout schedule.

17. The method of claim 16 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 100 | 200 | 300 | 400 | 500 |
| FOUR 2's, 3's or 4's | 50 | 100 | 150 | 200 | 250 |
| FOUR 5's THRU KINGS | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5. |

18. The method of claim 11 further including the player wagering at least one coin to be eligible to participate in the game and in which the predetermined amount that the player is paid is based on the number of coins wagered by the player.

19. The method of claim 18 further including the player making a second wager to replay his initial hand.

20. The method of claim 11 in which the game is displayed on a video display screen on an electronic gaming machine.

21. A method of playing a draw poker game comprising:

a) dealing an initial five card hand to a player;

b) the player either standing on the initial hand or discarding one or more cards from the initial hand;

c) dealing the player replacement cards for the discarded cards, if any, to form a final five card hand;

d) determining a value for the player's final five card hand based on poker hand ranking;

e) if the player's final five card hand is a winning hand, awarding the player a predetermined amount based on the value of the player's final five card hand;

f) on a random basis, offering the player an opportunity to replay his initial hand by discarding the player's final five card hand and re-dealing to the player the same initial five card hand having cards of the same suit and rank that were dealt to the player in step (a), and repeating steps (b) through (e).

22. The method of claim 21 in which each deck of playing cards is a standard 52 card deck.

23. The method of claim 21 in which each deck of playing cards is a standard 52 card deck plus at least one extra Joker card which is treated as a wild card.

24. The method of claim 21 in which each deck of playing cards is a standard 52 card deck with at least one of the cards being treated as a wild card.

25. The method of claim 21 in which the value of the player's final five card hand is determined by comparing the poker hand ranking of the player's final five card hand to a payout schedule.

26. The method of claim 25 in which the predetermined amount based on the value of the player's final five card hand is based on a payout schedule.

27. The method of claim 26 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5. |

28. The method of claim 21 further including the player wagering at least one coin to be eligible to participate in the game and in which the predetermined amount that the player is paid is based on the number of coins wagered by the player.

29. The method of claim 28 further including the player making a second wager to replay his initial hand.

30. The method of claim 21 in which the game is displayed on a video display screen on an electronic gaming machine.

* * * * *